US007662071B2

(12) United States Patent
Ditolla

(10) Patent No.: US 7,662,071 B2
(45) Date of Patent: Feb. 16, 2010

(54) VERTICLE EXERCISE BICYCLE

(75) Inventor: Christiaan Ditolla, Northport, NY (US)

(73) Assignee: Bloomington Dynamics, Inc., Northport, NY (US)

( * ) Notice: Subject to any disclaimer, the term of this patent is extended or adjusted under 35 U.S.C. 154(b) by 470 days.

(21) Appl. No.: 10/861,785

(22) Filed: Jun. 4, 2004

(65) Prior Publication Data

US 2005/0272567 A1 Dec. 8, 2005

(51) Int. Cl.
*A63B 22/12* (2006.01)

(52) U.S. Cl. ..... 482/62

(58) Field of Classification Search ..... 482/51, 482/57, 62, 148, 94, 102, 93, 104, 121, 123, 482/142, 488; 601/27, 29, 32, 33, 34, 35, 601/36

See application file for complete search history.

(56) References Cited

U.S. PATENT DOCUMENTS 4,199,139 A * 4/1980 Mahnke et al. ..... 482/101
4,463,945 A 8/1984 Spector
4,477,072 A 10/1984 DeCloux
4,519,603 A 5/1985 DeCloux
4,533,136 A 8/1985 Smith et al.
4,705,269 A * 11/1987 DeBoer et al. ..... 482/62
4,739,984 A * 4/1988 Dranselka ..... 482/60
4,768,782 A 9/1988 Blackburn
4,842,269 A 6/1989 Huang
4,880,227 A * 11/1989 Sowell ..... 482/102
4,898,381 A * 2/1990 Gordon ..... 482/103
4,958,831 A 9/1990 Kim
4,958,832 A 9/1990 Kim
5,242,347 A * 9/1993 Keeton ..... 482/102
5,312,312 A * 5/1994 Fernandez et al. ..... 482/60
5,423,728 A 6/1995 Goldberg
5,722,916 A 3/1998 Goldberg
5,746,684 A * 5/1998 Jordan ..... 482/62
5,967,946 A 10/1999 Beatty, Jr.
6,032,970 A 3/2000 Porter
6,206,806 B1 3/2001 Chu
6,299,189 B1 10/2001 Chao
6,361,479 B1 3/2002 Hildebrandt et al.
6,485,041 B1 11/2002 Janssen
6,698,962 B2 * 3/2004 Wang ..... 403/109.4
6,702,722 B1 * 3/2004 Arroyo, Jr. ..... 482/62
7,040,832 B2 * 5/2006 Hsieh ..... 403/109.3
7,104,939 B1 * 9/2006 Martinez ..... 482/142
2006/0019804 A1 * 1/2006 Young ..... 482/93

* cited by examiner

*Primary Examiner*—Loan H Thanh
*Assistant Examiner*—Tam Nguyen
(74) *Attorney, Agent, or Firm*—Law Office of Leo G. Lenna

(57) ABSTRACT

A vertical exercise apparatus having overhead and waist high support rails capable of supporting the users body weight for use in conditioning upper body and lower body muscle groups. A kit having overhead and waist high support bars with attachment clamps that attach to a conventional exercise bike so as to convert the conventional exercise bike into a vertical exercise apparatus for use in conditioning upper body and lower body muscle groups.

6 Claims, 5 Drawing Sheets

VERTICLE EXERCISE BICYCLE

FIELD OF THE INVENTION

The present invention relates to the field of exercise equipment and more specifically to an exercise apparatus that provides a means for both upper body exercise and lower body exercise.

BACKGROUND OF THE INVENTION

In recent years, bodybuilding has become extremely popular with the general public interested in a better quality of life. The benefits of aerobic and strength training exercise have been proven to provide significant health benefits that greatly improve the quality of life of those individuals willing and able to engage in such activities.

Presently there is a variety of exercise equipment available on the market today that is designed to provide both aerobic as well as strength training exercise. Much of this equipment is expensive and complex to use. Some equipment even requires a workout regiment longer and more strenuous than the average user is capable of enduring. Since the majority of users of exercise equipment today are not professional or even amateur athletes but are instead busy individuals seeking the physiological benefits associated with exercise, the more complex types of exercise equipment causes many problems. Even though exercise has been proven to be beneficial to ones health, many users have only a limited amount of time to complete an exercise regiment and desire exercise that takes as little time as possible with the greatest amount of physical conditioning.

To achieve the most physiological benefit in the least amount of time it is necessary to utilize the most muscle mass for a given exercise. Many exercise machines concentrate on either aerobic or strength training exercise but few are capable of providing both. In general, aerobic forms of exercise train the lower body muscles. For example, exercises such as running, stair climbing, elliptical training, and conventional bicycling all provide aerobic training but train only the lower extremities. Strength training machines are usually designed to target specific muscles and provide little if any aerobic benefits.

One exercise device that can provide low impact, cardiovascular exercise as well as strength training is the stationary exercise bike. The stationary exercise bike is easy to use and enables the user to benefit from both aerobic cardiovascular exercise as well as strength training. However, as stated above, the strength training is limited to the legs and other portions of the lower body. Thus, use of a conventional exercise bike alone enables the user to get a lower body workout but fails to provide an overall fitness regimen that provides both cardiovascular aerobic exercise and anaerobic/strength training for both the upper and lower body. In other words, the conventional exercise bike alone does not allow a user to enjoy both upper and lower body physical benefits, as does the device of the present invention.

In view of the foregoing, in order to achieve such a workout the user must use two and sometimes three machines. This type of workout is usually inappropriate and/or cumbersome for today's user. For example, a multiple machine approach to cardiovascular and strength training requires a large amount of equipment storage space. Equipment storage space is normally a particularly important issue for home exercise equipment since the typical home has very limited space available for an exercise area.

The multiple device approach also increases exercise time because it requires the user to shift from one machine to the next after each workout set. In addition, down time while shifting from one machine to another negatively impacts the usefulness of the exercise regimen by allowing a rest period between exercises. The multiple machine approach to a home gymnasium also increases equipment cost to the user by requiring the user to purchase multiple machines. For these reasons and more, the use of multiple exercise machines to provide a complete workout of both upper and lower muscle groups is not practical for a large percentage of the exercising public.

Thus, for all of these reasons and others, there is a need for a space saving, cost efficient multiple use exercise bike that can provide the user with the aerobic/cardiovascular exercise of an exercise bike as well as strength conditioning of the lower and upper muscle groups normally associated with the use of multiple machines.

The exercise apparatus of the present invention overcomes the prior art limitations discussed above by providing a single exercise apparatus that enables the user to achieve cardiovascular exercise, in the form of an exercise bike, and an upper body strength training workout through use of the users own body weight. In addition, the exercise apparatus of the present invention provides more physical benefits, requires less storage space than multiple machines, and is less costly than purchasing multiple machines.

Simply stated, the exercise apparatus of the present invention is more efficient than most exercise machines available today since it enables the user to stimulate many different muscle groups in both the upper and lower extremities utilizing more muscle mass. The more muscle mass exercised, the more energy required to complete the exercise regimen and therefore the more calories burned per unit time compared to exercise machines unable to stimulate the same muscle mass. This translates to shorter workout time with greater aerobic and strength benefits.

All in all the exercise machine of the present invention or the exercise machine created using the conversion kit of the present invention provides triceps and bicep/lateral workouts where the conventional seated stationary bike, the stair climber and the elliptical exercise machine do not workout these muscle groups at all. Therefore the exercise machine of the present invention is able overcome to the shortcomings of the prior art exercise machines described above.

SUMMARY OF THE INVENTION

The present invention is directed to an exercise machine designed for both anaerobic strength-building workouts as well as for cardiac conditioning aerobic workouts. The exercise machine of the present invention is designed so that the user can achieve both an upper and lower body workout in a single device. The machine is easy to use, compact and cost affective.

One embodiment of the exercise machine of the present invention includes a weight-bearing frame having a base that is designed for both durability and stability. The weight-bearing frame is in contact with the floor so as to provide support for the rest of the device as well as the user when in operation. The frame may be equipped with stabilization bars that extend perpendicular to the main axis of the frame so as to provide lateral as well as front to back stability. The frame may be constructed from steel, alloy metal, carbon-based composite or any other material that can provide both strength and stability.

In one embodiment of the present invention the exercise machine comprises all of the features described above as well as a weight-bearing frame with a seat attached. The seat comprising a resting surface that extends upwards from the frame. The resting surface of the seat may be made of molded plastic, padded or filled with contour accepting gel. The seat is designed so as to provide a resting surface for the user when either performing a lower body workout or resting after a high intensity exercise set.

The exercise machine of the present invention may also be equipped with a set of foot levers having two peddles spaced furthest from each other on the same plain connected by a rail and axle system. The axle system is perpendicular to the rail and parallel to the pedals. In one embodiment of the present invention, the axle of the foot lever is attached to either a single weighted wheel or a wheel equipped with a variable tension drag system. In the embodiment where the foot lever is attached to the weighted wheel the weight of the wheel itself provides some resistance to rotation of the foot lever and enhance the users workout.

In the embodiment of the exercise machine where the foot lever is attached to a wheel equipped with a drag system, the drag system can be adjusted so as to increase or decrease the tension on the foot lever therefore increasing or decreasing the force required by the user to overcome the tension. By adjusting the tension the user can obtain a lower-body strength-building workout and by decreasing the drag the user is able to peddle quickly so as to raise the user's heart rate providing for an aerobic cardiac workout.

The exercise machine described above also comprises a first and second set of support bars that are attached to the base of the exercise machine. The first set of support bars is positioned above the second set of support bars. In one embodiment of the invention the first set of support bars are positioned at about two times the height of the second set of support bars. In other words, the first set of weight-bearing support bars are positioned so that the user can grab on to them when their hands are above their head.

In the embodiment that includes the seat, the support bars must be strong enough to support the weight of the user so that the user is able to pull himself or herself from a sitting position using a pull-up motion and support his or her own body weight while continuing to peddle the foot levers. This way the user can work out his or her's lower body as well as his or hers upper body.

The second set of support bars are positioned waist high to the user. When the user stands on the peddles the support bar is designed to support the weight of the user. These support bars are used to support the user while peddling in the upright position at high speeds and provide strength benefits from supporting ones body weight as well as a strength building exercise. The first and second set of support bars may be attached to the frame by an adjustable height bracket so as to accommodate different users.

In one embodiment of the present invention the exercise machine is equipped with a programmable unit comprising a memory card, an alert system, and recording capability. The programmable unit can be used to design different exercise routines as well as inputting programs that can be used to calculate calories burned, miles peddled, speed obtained, heart rate calculations, etc. The alert system can be used to alert the user once he or she has completed a certain distance/speed as part of an exercise routine. The exercise machine may also be equipped with a keyboard for inputting data/text.

In still another embodiment of the invention a conventional exercise bike can be converted to a vertical exercise bike using the vertical bike conversion kit of the present invention. The kit comprises a set of weight-bearing frames having a base that when erected the base of each of the frames is in contact with the floor and provides support for each of the frames as well as the person working out on the exercising machine. The kit also includes a cross bar that can be connected to a portion of the frame so as to maintain each frame equal-distant from each other. The distance between the frames can be adjusted by adjusting the size of the crossbar. This allows the kit to adjust to almost any size conventional exercise bike. Once the frame with the cross bar is set in place a first attachment clamp attached to one frame and a second attachment clamp attached to other frame can be adjusted so as to attach to a portion of the stationary exercise bike. Once in place, the stationary exercise bike can be used to workout both the upper and lower body.

As stated in the Background of the Invention section of the application at bar, the exercise machine of the present invention or the exercise machine created using the conversion kit of the present invention provides triceps and bicep/lateral workouts where the conventional seated stationary bike, the stair climber and the elliptical exercise machine do not workout these muscle groups at all. In addition to providing the aforementioned workout, the present invention also provides for a speed workout/sprint-cardiac workout. Although the conventional seated exercise bike provides this type of workout, the elliptical exercise machine and the stair climber do not. Still further the present invention also provides a force greater than body weight, upstroke resistance as well as an upright posture workout. To the contrary, neither the conventional seated exercise bike, the elliptical machine nor the stair climber provides all of these workouts in a single compact exercise machine.

Figure 1:
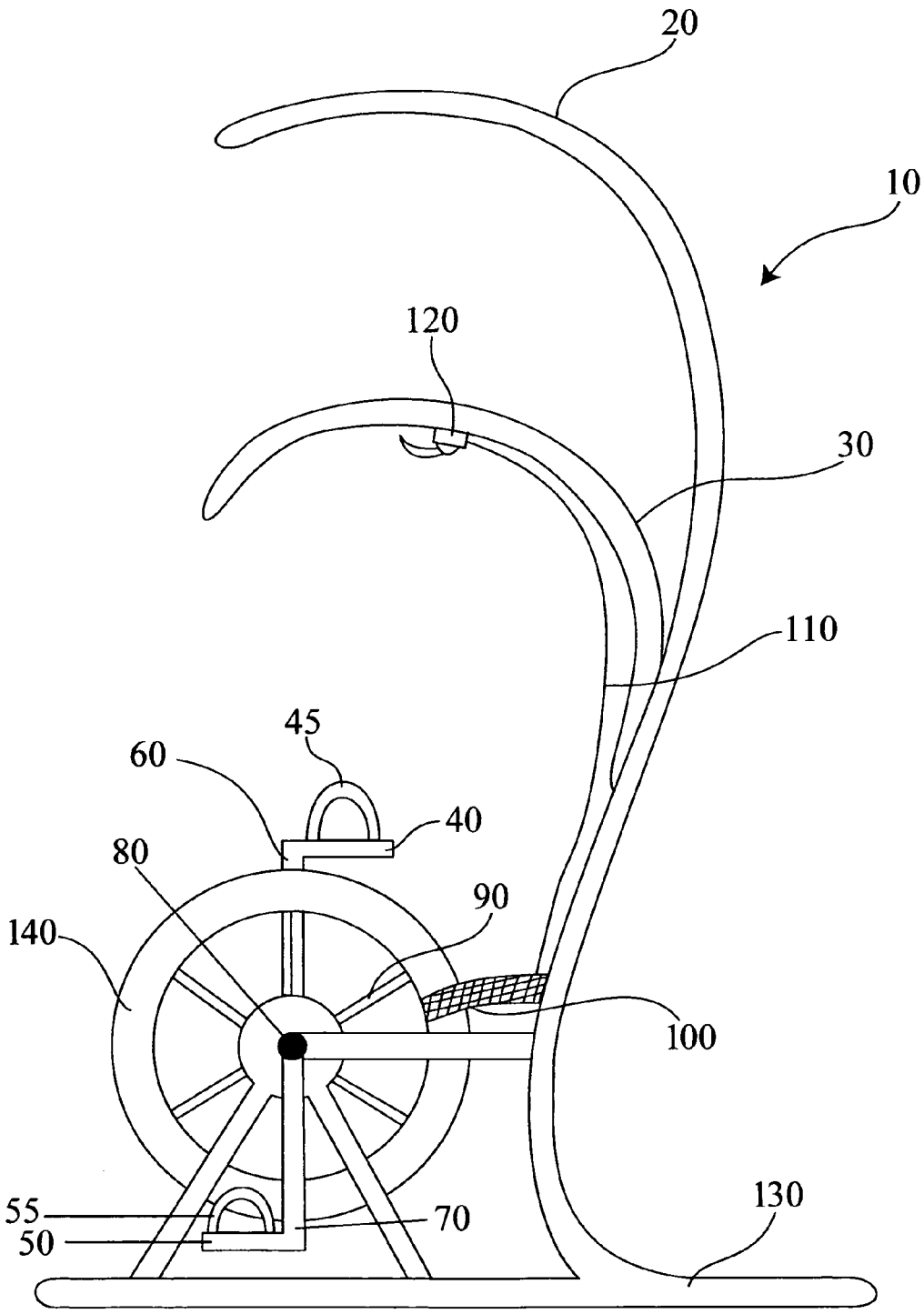
FIG. 1.

(10) vertical bike apparatus
(20) overhead support bar
(30) waist high support bar
(40) first peddle
(45) first peddle strap
(50) second peddle
(55) second peddle strap
(60) first peddle riser
(70) second peddle riser
(80) axle
(90) spokes
(100) adjustable brake pad
(110) adjustable brake pad cable
(120) adjustment lever for brake pad
(130) vertical bike stand
(140) wheel

Figure 3:
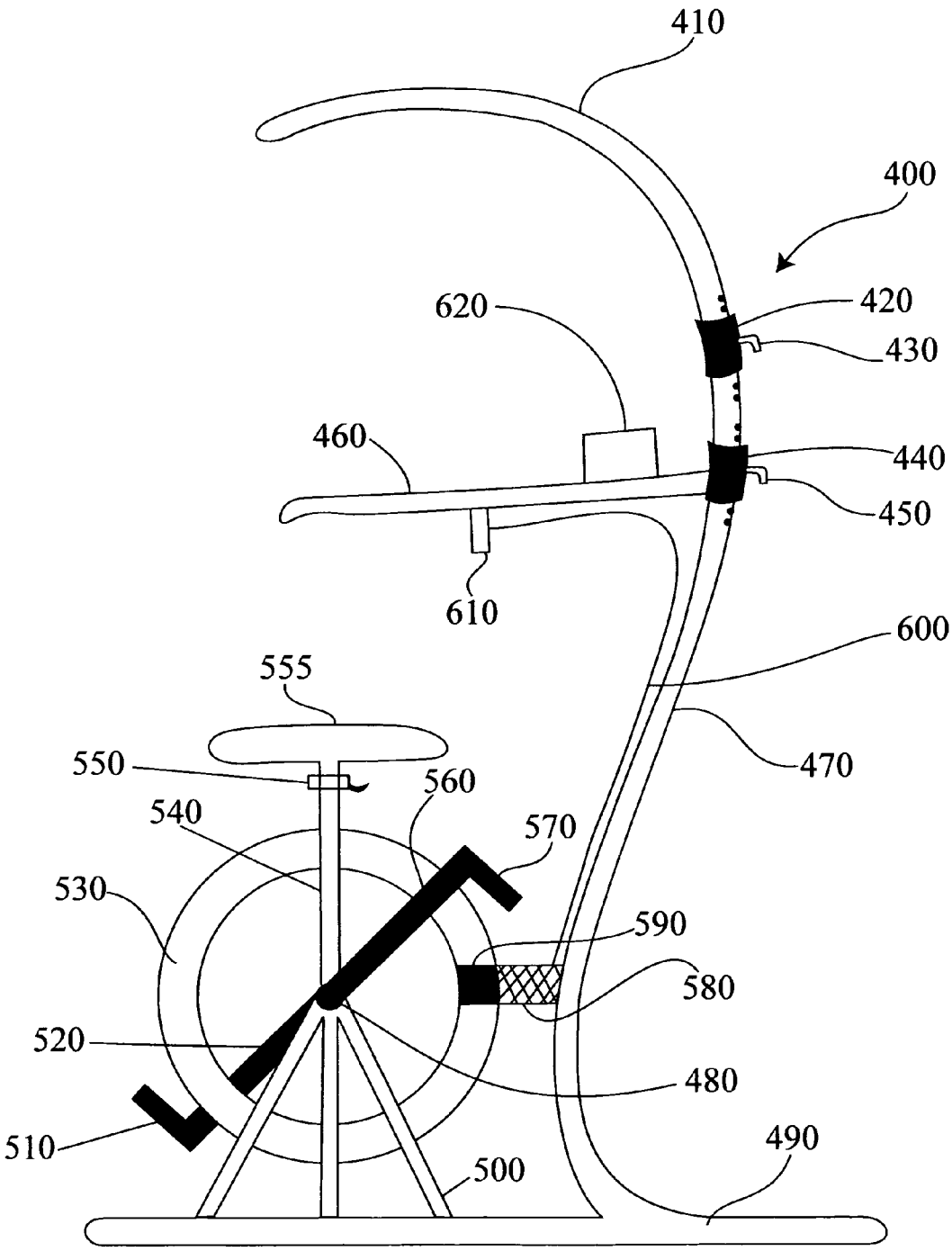

FIG. 2:

(200) vertical bike apparatus
(210) first overhead support bar
(220) second overhead support bar
(230) first waist high support bar
(240) second waist high support bar
(250) first vertical bike stand
(260) second vertical bike stand
(270) wheel
(280) first peddle
(290) second peddle
(300) axle
(310) first peddle riser
(320) second peddle riser
(330) wheel stand (340) cross bar
(350) adjustable brake pad
(360) first adjustable brake pad cable
(370) second adjustable brake pad cable
FIG. 3:
(400) seated vertical bike apparatus
(410) adjustable overhead support bar
(420) adjustable overhead support bar collar
(430) quick release adjustment for overhead support bar
(440) adjustable waist high support bar collar
(450) quick release adjustment
(460) waist high adjustable bar
(470) frame
(480) axle
(490) floor stand of frame
(500) wheel stand
(510) first peddle
(520) first peddle riser
(530) wheel
(540) adjustable seat support
(550) quick release for seat
(560) second peddle riser
(570) second peddle
(580) adjustable brake pad support
(590) adjustable brake pad
(600) adjustable brake pad cable
(670) adjustable brake pad
(680) recordable/programmable computer processing unit
FIG. 4:
(700) seated vertical bike apparatus
(710) first adjustable overhead support bar
(720) second adjustable overhead support bar
(730) first adjustable overhead collar
(740) second adjustable overhead collar
(750) second quick release
(760) first quick release
(770) cross bar
(780) programmable computer processing unit
(790) first adjustable waist high support bar
(800) second adjustable waist high support bar
(810) first adjustable waist high support collar
(820) second adjustable waist high support collar
(830) first quick release for waist high support collar
(840) second quick release for waist high support collar
(850) first stand support
(860) second stand support
(870) first adjustable brake pad cable
(890) adjustment for second adjustable brake pad cable
(900) second adjustable brake pad cable
(910) first brake pad connector
(920) second brake pad connector
(930) adjustable seat
(940) adjustable seat shaft
(950) quick adjustment for seat height
(960) wheel
(970) friction brake pad
(980) first peddle
(990) second peddle
(1000) first peddle riser
(1010) second peddle riser
(1020) wheel axle
(1030) first floor stand support
(1040) second floor stand support
(1050) seat support
FIG. 5:
(1100) overhead/waist high support bars conversion kit
(1110) first adjustable overhead support bar
(1120) second adjustable overhead support bar
(1130) first adjustable waist high support bar
(1140) second adjustable waist high support bar
(1150) second adjustable overhead collar
(1160) first adjustable overhead collar
(1170) first quick release
(1180) adjustable cross bar
(1190) adjustable collar
(1200) quick release
(1210) second adjustable waist high collar
(1220) quick release
(1230) first adjustable waist high collar
(1240) quick release
(1250) first frame support
(1260) second frame support
(1270) second adjustable bike attachment
(1280) first adjustable bike attachment
(1290) first adjustable bike attachment clamp
(1300) second adjustable bike attachment clamp
(1310) second adjustable bike attachment clamp collar
(1320) quick release
(1330) quick release
(1340) first adjustable bike attachment clamp collar
(1350) first stand balance support
(1360) second stand balance support
(1370) instructions
(1380) assembly tool

DETAILED DESCRIPTION OF THE FIGURES

FIG. 1 shows a cross section of the vertical exercise bike of the present invention. The vertical exercise bike (10) of the present invention comprises an overhead bar (20) and a waist high support bar (30) in communication with the bike stand (130). The peddling bike portion of the vertical exercise bike of the present invention comprises a wheel (140) having an axle (80) as well as spokes (90) for support. Attached to the axle (80) of the wheel (140) is a first peddle riser (70) on one side of the wheel (140) and a second axle riser attached to the opposite side of the axle (80). The first and second risers are both attached to the axle (80) at one end and to the peddles at the other.

The first peddle riser (60) is attached to a first peddle and the second peddle riser (70) is attached to a second peddle. The first and second peddles/risers are positioned so that when one peddle is at its highest point the second peddle is at its lowest. This allows a person to alternate downward pressure on one peddle causing the other to rise. Repeating this process allows the wheel (140) to rotate. This method of peddling without any other movement limits the user's workout to his or her lower muscle groups. If the user simply grabs hold onto the waist high support bar (30) the user would be able to exert additional downward force greater than the user's own bodyweight onto the peddles thus providing increased strength training not available with a conventional exercise bike.

In one embodiment of the invention, the wheel is a weighted wheel wherein the weight of the wheel provides rotational. In an alternate embodiment of the present invention, the wheel is replaced with a belt means capable of providing various amounts of tension. Increasing the tension on the belt means makes it harder to rotate and therefore requires greater muscle mass of the user to rotate the belt. Whether a wheel or a belt system is used the concept remains the same, the greater the resistance placed on the peddles, the greater the muscles mass required to rotate the belt or wheel during exercising. In additional, the peddles are designed so that they can be rotated in the forward or backward direction. Rotating the peddle in the forward direction conditions one group of muscle while rotating the peddles in the reverse direction conditions a different group of muscles.

The overhead bar (20) extends past the axle (80) of the wheel (140) so that the bar is accessible to a user peddling during a working out on the vertical bike. The waist high support bar (30) is also positioned past the axle (80) of the wheel (140) so that a person peddling during a workout is able to grab hold to the waist high support bar (30) and support his or her weight while continuing to peddle. Supporting one's own weight provides for an upper body workout while at the same time peddling the bike would provide a lower body workout. In order to adjust to the height of the user both the overhead support bar (20) and the waist high support bar (30) can be made to be adjustable (Shown in FIG. 3).

The vertical bike of the present invention also allows for extended high-speed cardiovascular training greater than what can be achieved by either a stair climber, or elliptical trainer. Although high speed cardiovascular peddling can be achieved on a conventional bike, greater muscle mass can be achieved on the vertical bike of the present invention and additional body muscles can be worked on while doing a high-speed cardiovascular peddling session. Also resistance is possible when peddling in the backward motion emphasizing different muscle groups as in ascending and climbing up and down an incline.

To achieve high speed cardiovascular peddling using the vertical bike of the present invention the user must strap his or her feet onto the first and second peddles (40,50) using the first and second peddle straps (45, 55) so as to keep the users feet attached to the peddles during high speed training. This motion is not possible when exercising on a stepper or an elliptical machine. Using the waist high support bars (30) to support most of the users weight the user can then rotate the peddles (40, 50) at an accelerated rate of speed. This speed can be maintained for as long as the user is able to support his or her body weight off of the peddles providing upper strength workout. Having less weight on the peddles makes it easier for the wheel (140) to rotate and therefore allows the user to reach maximum peddle acceleration. As an alternative method, the user could grab onto the overhead bars (200) to support his or her weight therefore putting less weight onto the peddles and allowing the user to obtain high speed cardiovascular training while at the same time strength training several muscle groups in the upper portion of the body.

In stark contrast, the conventional exercise bike that allows the user to sit on a seat in order to remove weight off of the peddles during a high speed cardiovascular peddling does not work out any muscle groups other than those associated with high speed peddling. In addition, supporting one's own weight using the support bars also allows the user to burn additional calories as compared to a seated workout. Therefore the benefits over the conventional exercise bike are clear. Simply stated peddling upright provides a greater workout than the conventional seated exercise bike.

Increasing tension on the wheel (140) can also provide additional benefits during a workout. For this reason the present invention can also be equipped with an adjustable tension brake attached to the wheel. FIG. 1 shows the wheel (140) equipped with an adjustable brake pad (100). The adjustable break pad (100) is shown attached to an adjustment lever (120) located on the waist high support bar (30) by an adjustable brake pad cable (110). Utilizing lever (120) the user can adjust the tension placed on the wheel (140) by the brake pad (100), lessening the tension for high-speed cardiac workouts and increasing the tension for lower body strength training.

Figure 2:
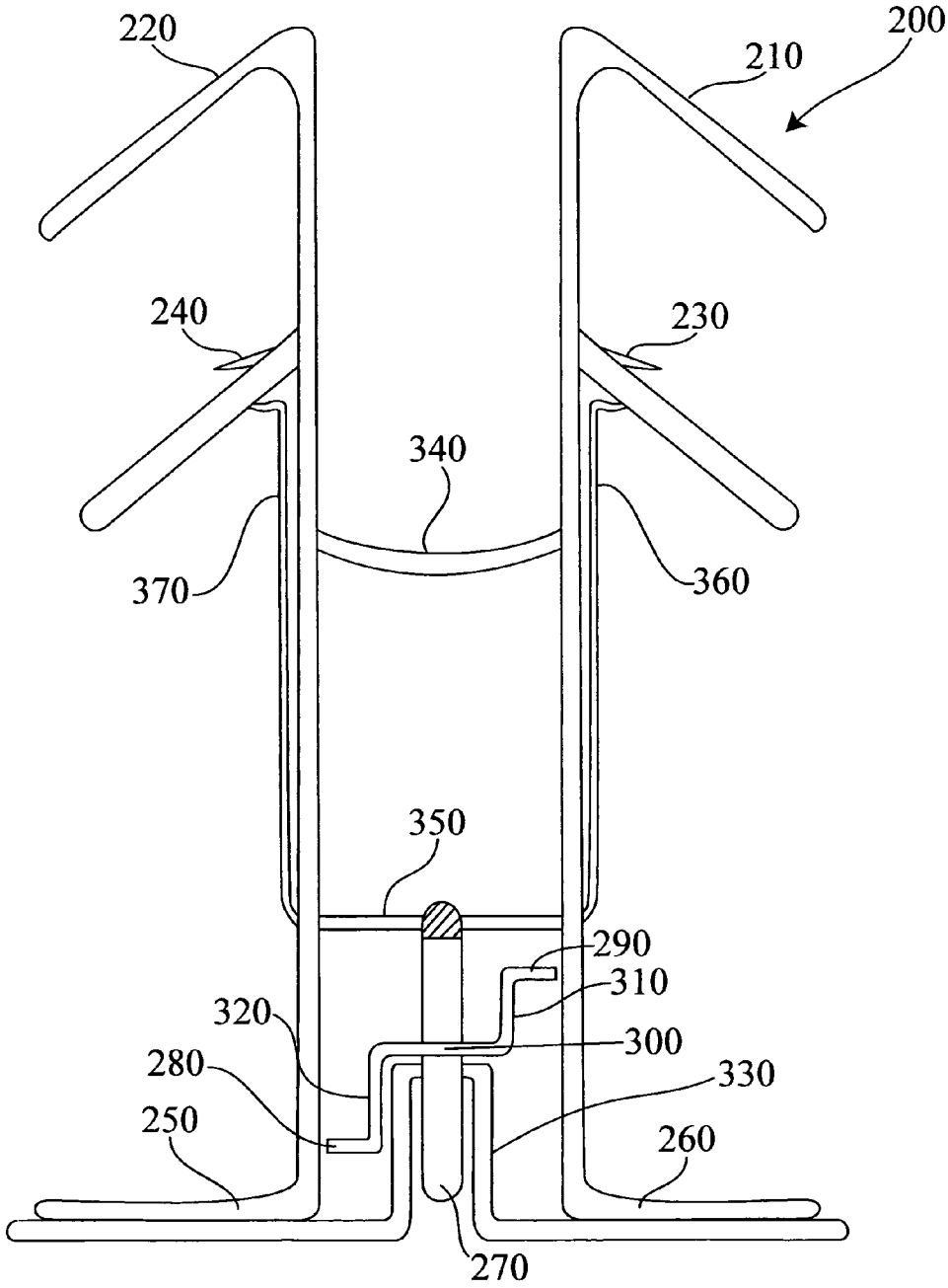

FIG. 2 shows a posterior view of the vertical exercise bike of the present invention. The vertical bike apparatus (200) of the present invention comprises first and second overhead support bars (210, 220) and first and second waist high support bars (230, 240). The first overhead support bar (210) and the first waist high support bar (230) are connected to the first vertical bike stand (250) and the second overhead support bar (220) and the second waist high support bar (240) are connected to the second vertical bike stand (260). Both the first and second bike stands (250, 260) provide support for the overhead and waist high support bars as well as the weight that the user places on the support bars during exercise.

Basically the vertical exercise bike apparatus (200) is constructed of two separate sections with the first section comprising the first overhead support bar (210), the first waist high support bar (230) and the first vertical bike stand (250) and second section comprising the second overhead support bar (220), the second waist high support bar (240), and the second vertical bike stand (260). The first and second sections are connected to each other by cross bar (340). The cross bar (340) is adjustable having several different positions. Extending the cross bar (340) provides a greater distance between the two sections. Retracting the cross bar (340) reduces the distance between the two sections. The wheel (270) is connected to a wheel stand (330) that is also connected to the first and second vertical bike stands (250,260). The portion of the wheel stand (330) that connects to the first and second sections of the vertical bike stands (250,260) can be adjusted to the distance between the first and second sections of the vertical exercise bike (300).

The wheel (270) has an axle (300) that is in physical communication with the first peddle riser (310) on one side of the axle (300) and the second peddle riser (320) on the other. The first and second peddle risers are connected to first and second peddles (280,290) respectfully and are positioned approximately 180 degrees away from each other. In other words, when one peddle is at its highest point in its rotation the other peddle is at its lowest point of its rotation. The peddles of the present invention are designed to have an increased surface area making them better suited for weight bearing exercise. For example, the peddles of the present invention may be designed so that the length of the pair of peddles attached to the top and bottom portions of the foot lever is at least 5 inches and the width of the pair of peddles attached to the top and bottom portions of the foot lever is at least 3 inches.

Alternating the peddles from high to low positions results in rotation of the wheel as described in FIG. 1. The wheel (270) is connected to an adjustable brake pad designed to adjust tension on the wheel. The adjustable break pad (350) is attached to first and second adjustment brake pad cables lever (360,370) located on waist high support bars (230,240). The cables can be attached to a lever for manual adjustment or a solenoid type device (not shown) that can be programmed to alternate tension on the cables which in turn alternate tension on the adjustable brake pads. Alternating tension on the wheel via the adjustable brake pad can allow a user to alternate between a cardiac workout and a strength endurance workout.

FIG. 3 shows a side view of the seated vertical exercise bike of the present invention. The seated exercise vertical bike (400) like FIGS. 1 and 2 described above comprises an overhead bar (410) and a waist high support bar (460) in communication with the frame (470). The frame (470) continues and connects to the floor stand for the frame (490). Unlike FIGS. 1 and 2 the overhead bar (400) further comprises an adjustable overhead bar collar (420) having a quick adjustment release lever (430). The quick adjustment release lever (430) is used to adjust the length and height of the overhead support bar according to the users needs. In addition, FIG. 3 also shows an adjustable waist high bar collar (440) having a quick adjustment release lever (450). The quick adjustment release lever (450) is used to adjust the length and height of the waist high support bar according to the users needs.

The peddling portion of the seated vertical exercise bike of the present invention comprises a wheel (530) having an axle (480) as well as spokes for support. Attached to the axle (480) of wheel (530) is a first peddle riser (510) on one side of the wheel (530) and a second peddle riser (560) attached to the opposite side of the axle (480). The first and second risers are both attached to the axle (480) at one end and to the peddles at the other. The first peddle riser (520) is attached to a first peddle (510) and the second peddle riser (560) is attached to a second peddle (570). The first and second peddles/risers are positioned so that when one peddle is at its highest point the second peddle is at its lowest. This allows a person to alternate downward pressure on one peddle causing the other peddle to rise. Repeating this process allows the wheel (530) to rotate.

Also attached to the wheel (530) and/or axle (480) is a seat (550) that is further attached to an adjustable seat support (540). The adjustable seat support (540) comprises a quick release for the seat (550) that can be used to adjust the height of the seat according to the user.

FIG. 3 also shows an exercise bike that comprises a recordable/programmable computer-processing unit (CPU) (620). The recordable/programmable CPU can be used to record heart rates, exercise routines, calories burned, or any other data the user may require during his or hers workout. The CPU can also be attached to the adjustable brake pad and can either increase or decrease tension on the wheel (530) either making it harder or easier for the user to peddle the wheel. Different exercise programs can be selected by the user so as to provide different types of workouts. The CPU can also be used to calculate body fat, muscle density and the like.

Figure 4:
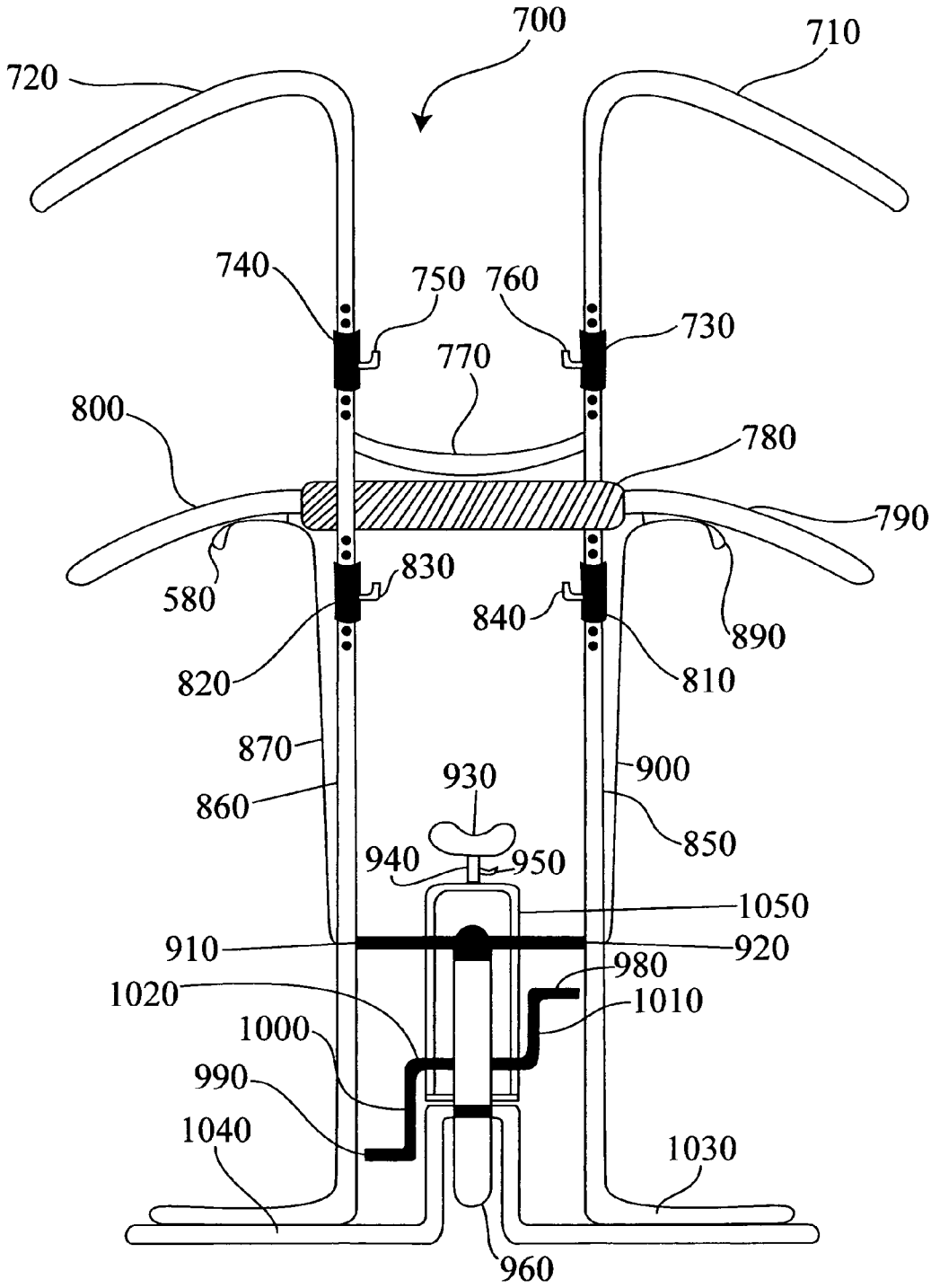

FIG. 4 shows a posterior view of the seated vertical bike of the invention (700). The seated vertical bike of the invention (700) shows all of the components in FIG. 3 in a left and right orientation.

Figure 5:
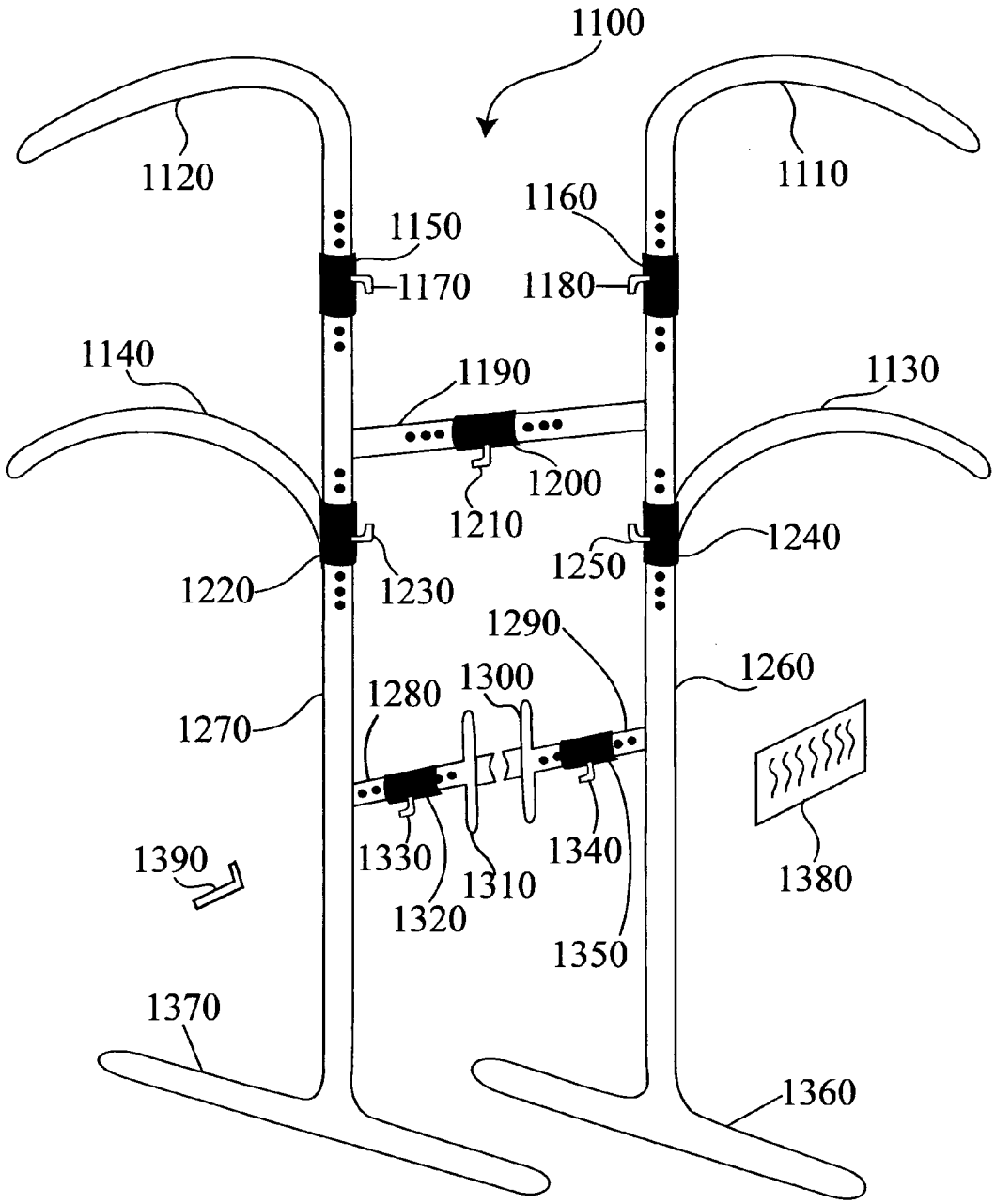

FIG. 5 shows a posterior view of an overhead/waist high support bar conversion kit of the present invention (1100). The conversion kit of the present invention is designed to transform a standard/conventional exercise bike into a vertical exercise bike of the present invention. Exercise bikes can be expensive and the user can become accustomed to using a specific machine. In these cases the conversion kit can be used to transform a standard exercise bike into a vertical bike of the present invention for less than what it would cost to purchase a complete vertical exercise bike. In addition, a user can not only save money using the kit of the present invention but can also continue to use his or her favorite standard exercise bike with the additional benefits of the vertical bike of the present invention.

The conversion kit comprises a first adjustable overhead support bar (1110), a second adjustable overhead support bar (1120), a first adjustable waist high support bar (1130) and a second adjustable waist high support bar (1140). The first adjustable overhead support bar (1110) comprises a first adjustable overhead collar (1160) and the second adjustable waist high support bar (1140) comprises a second adjustable waist high collar (1150). The first and second adjustable overhead collars (1150, 1160) comprises a first and second quick release (1170, 1180) respectively that can be used to adjust the height of the overhead support bars and the waist high support bars according to the user height.

Different conventional exercise bikes can have different widths. In order for the conversion kit of the present invention to accommodate as many different models of conventional exercise bikes as possible the kit comprises an adjustable cross bar (1180) having an adjustable collar (1190). The adjustable cross bar (1180) can be adjusted by using a quick release (1200) located on the adjustable collar (1190). By extending and retracting the cross bar (1180) the distance between the first and second frames (1240, 1260) can be adjusted to fit almost any size conventional exercise bike.

The conversion kit also comprises a first adjustable bike attachment (1270) and a second adjustable bike attachment (1280). The first adjustable bike attachment (1270) comprises a first adjustable bike attachment clamp (1290) and a first adjustable bike attachment clamp collar (1340). The second adjustable bike attachment (1280) comprises a second adjustable bike attachment clamp (1310) and a second adjustable bike attachment clamp collar. Both the first and second adjustable bike attachments are equipped with quick releases (1320, 1330). The quick releases can be used to increase or decrease the distance between the first and second frame sections. Once adjusted to the desired distance between the first and second frames the first and second adjustable bike attachment clamps can be attached to some portion of the conventional exercise bike so as to anchor the bike in place. One portion of the conventional bike that can be used to for attachment on the conventional bike is each end of the axle.

Once the adjustable bike attachment clamps and the cross bar is adjusted to the necessary width and the conventional bike is anchored in place the user can enjoy all of the benefits of a vertical exercise bike of the present invention. In other words, with the first stand balance support (1350) and the second stand balance support (1360) providing support for the weight of the user, the user can use his or her own body weight for endurance/strength training. In addition the user can use the weight-bearing waist high support bars to lift the user's weight off of the peddles so as to allow for enhanced speed cycling. This type of speed cycling provides for an enhanced cardiac workout. The kit may also include instructions (1370) and assembly tools (1380).

In another embodiment of the conversion kit for a stationary exercise bike of the present invention, the kit comprises a single frame with a set distance between both support bars wherein the frame has a u-shaped base. The u-shaped base provides support for the frame as it comes in communication with the floor. A nonadjustable cross bar is attached to the frame that provides additional support to the device. The frame also contains at least one attachment clamp that is designed to attach to the conventional stationary bike so as to transform it into the vertical exercise bike of the present invention. The attachment clamp is secured to the frame by an adjustable attachment that can be adjusted to attach to the stationary bike.

The embodiments described above can be constructed of extruded steel, metal alloy, synthetic plastics, molded polyplastics, and the like according to standard manufacturing procedures used to produce weight bearing products. The device of the present invention can be produced as several components that need to assemble or can be produced as a single unit. Shipping requirements as well cost considerations are two key factors that are used to determine how the device of the present invention is manufactured. In other words, a person skilled in the art of manufacturing armed with the present disclosure would be able to manufacture the device as a single unit or as components that need to be assembled before use.

While the invention has been illustrated and described with respect to specific illustrative embodiments and modes of practice, it will be apparent to those skilled in the art that various modifications and improvements may be made without departing from the scope and spirit of the invention. Accordingly, the invention is not to be limited by the illustrative embodiment and modes of practice.

What is claimed is:

1. An exercise machine comprising;

a frame having a forward and rearward portion and a longitudinal axis that bisects the frame, said frame connected to a base, said base adapted to be in communication with a floor whereby providing support for said frame;

a first and a second set of support bars attached to said frame, said first and second set of support bars being disposed laterally at a distance from and at an acute angle relative to said longitudinal axis and said first set of support bars positioned directly above and in alignment with said second set of support bars at about two times the height of said second set of support bars;

no more than one pedal assembly rotationally attached to said frame having an axle, two levers and two pedals wherein each of said two levers are attached to the distal ends of said axle and said pedals are attached to each lever so that said single pedal assembly provides rotation about said axle when alternative pressure is applied to said pedals;

a wheel assembly attached to said frame and said axle so that rotation of said axle also rotates said wheel; and an adjustable brake assembly in direct communication with said wheel assembly and configured to apply friction to said wheel assembly upon activation, wherein said first and second set of support bars are configured to extend rearward past said axle of said pedal assembly, and said support bars are adapted to be grasped by a user engaged to the machine via the pedals to provide support to the user during exercise.

2. The exercise machine according to claim 1 further comprising a seat attached to said frame having a resting surface, said resting surface extending upwards from said frame.

3. The exercise machine according to claim 2 further comprising an adjustable seat bracket attached to said frame wherein said seat is attached thereto.

4. The exercise machine according to claim 1 further comprising a first and a second support bar adjustable bracket, said first adjustable support bar bracket being in communication with said first set of support bars and said second support bar adjustable bracket being in communication with said second set of support bars.

5. The exercise machine according to claim 4 wherein said first and second set of support bars attached to said base further comprise a height adjustment means for adjusting the height of said first and second set of support bars from the floor.

6. An exercise machine comprising;

a frame having a forward and rearward portion and a longitudinal axis that bisects the frame, said frame connected to a base, said base adapted to be in communication with a floor whereby providing support for said frame;

a first and a second set of support bars attached to said frame, said first and second set of support bars disposed laterally at a distance from and at an acute angle relative to said longitudinal axis and said first set of support bars positioned directly above and in alignment with said second set of support bars at about two times the height of said second set of support bars, said bars are attached to said frame in a permanent non-movable configuration;

a single pedal assembly rotationally attached to said frame having an axle, two levers and two pedals wherein each of said two levers are attached to the distal ends of said axle and said pedals are attached to each lever so that said single pedal assembly provides rotation about said axle when alternative pressure is applied to said pedals;

a wheel assembly attached to said frame and said axle so that rotation of said axle also rotates said wheel; and an adjustable brake assembly in direct communication with said wheel assembly and an adjustment lever, said adjustment lever configured to adjust the amount of friction applied by said brake assembly to said wheel assembly upon activation, wherein said first and second set of support bars are configured to extend rearward past said axle of said pedal assembly, and said support bars are adapted to be grasped by a user engaged to the machine via the pedals to provide support to the user during exercise.

* * * * *